US006216906B1

(12) United States Patent
Koshikawa et al.

(10) Patent No.: US 6,216,906 B1
(45) Date of Patent: Apr. 17, 2001

(54) CAP FOR USE IN LIQUID CARTRIDGE AND LIQUID CARTRIDGE HAVING THE SAME

(75) Inventors: Hiroshi Koshikawa, Kawasaki; Masanori Takenouchi, Yokohama; Osamu Morita, Yokosuka; Kenji Kitabatake, Kawasaki; Kenichi Seino, Fukushima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,010

(22) Filed: Oct. 25, 1999

(30) Foreign Application Priority Data

Oct. 27, 1998 (JP) ..... 10-305531

(51) Int. Cl.[7] ..... B65D 41/00
(52) U.S. Cl. ..... 220/359.2; 347/86
(58) Field of Search ..... 220/359.1, 359.2, 220/359.4, 212.5; 347/86

(56) References Cited

U.S. PATENT DOCUMENTS 5,400,060 * 3/1995 Carlotta ..... 220/359.2 X
5,886,720 * 3/1999 Sasaki ..... 347/86
6,000,789 * 12/1999 Takagi et al. ..... 347/86
6,036,306 * 3/2000 Haigo ..... 347/86

* cited by examiner

*Primary Examiner*—Nathan J. Newhouse
(74) *Attorney, Agent, or Firm*—Fitzpatrick, Cella, Harper & Scinto

(57) ABSTRACT

An object of the invention is to provide a cap in use for liquid reserving cartridge and a liquid reserving cartridge having the same which can proceed stably to weld the cap onto the liquid cartridge, reduce an unsealing force without a welding strength and improve a handling easiness during unsealing, wherein: the cap 1 in use for liquid cartridge, which is provided with a liquid reserving portion 11 and a feeding portion 13 for feeding the liquid externally, comprises a facing 2 for covering the feeding port 13, welding portions to be welded with the liquid reserving cartridge 11 and a handling portion for unsealing the welded portions by means of rotating the cap 1, during that the welding portions opposing to each other with respect to a fulcrum of the rotating operation and being located on a center line which runs through both the rotating center and a substantial center line of the handling lever.

7 Claims, 7 Drawing Sheets

CAP FOR USE IN LIQUID CARTRIDGE AND LIQUID CARTRIDGE HAVING THE SAME

BACKGROUND OF THE INVENTION

1. Field of the Invention

The present invention relates to a cap for use in liquid cartridge for reserving a liquid to be supplied to a recording device of an ink-jet recording apparatus and to a liquid cartridge having the same.

2. Brief Description of the Related Art

A liquid which is employed as a recording liquid for use in ink-jet recording apparatus is reserved in a liquid reservoir for reserving a liquid. In an ordinary ink-jet recording apparatus, the liquid cartridge is formed to be detachable from the apparatus and equipped with a feeding port for feeding the liquid. The liquid cartridge prior to exchange is in general sealed with the cap etc. to prevent a leakage of the liquid.

Some of co-inventors of the present invention have proposed in the Japanese Laid-open Patent Application Numbered: 10-291326 (1998) a highly air-tight liquid reserving cartridge having a cap for sealing the feeding port which is provided on such a liquid cartridge without any creep deformation phenomena of the cap. The liquid reserving cartridge and the cap disclosed in the Laid-open Application mentioned above are illustrated in FIG. 8 (PRIOR ART).

In the conventional liquid reserving cartridge as shown in FIG. 8, the liquid reserving cartridge 101 serving as the liquid reservoir for reserving the liquid is provided with the feeding port 102. The cap 103 for closing up aforesaid feeding port 102 is fixed onto the cartridge 101 and the liquid cartridge 101 for reserving the liquid is sealed up by an elastic member 104 which is disposed on a plane to be contacted with the feeding port 102 of the liquid cartridge 101.

In the cap for use in liquid cartridge as mentioned above, the cap 103 is turned around during unsealing of the sealed liquid cartridge 101 thereby to shear off a welding portion 105, which removes the cap 103 from the liquid cartridge 101. As a method of fixing the cap 103 onto the liquid cartridge 101, a plurality of the welding portions 105 are first formed on a periphery of a cylindrical portion of the cap 103, which is used to encapsulate the feeding port 102, so as to protrude toward the liquid reserving cartridge 101 thereby to contact each of the welding portions 105 with the liquid cartridge 101 to fuse contacted planes between the welding portions 105 and the liquid cartridge 101 to be welded with each other by a use of an ultrasonic welding technology.

The ultrasonic welding technology is in general a sort of technologies wherein an ultrasonic vibration propagating body (referred to as "welding horn" hereinafter) contacts a member to have aforesaid member vibrate at a high frequency, friction heat of which fuses plastic resin-made welding portions thereby to be fixed. The ultrasonic vibration exhibits a larger amplitude at a portion of the member which is more adjacent to the welding horn while the amplitude is reduced more as the portion goes apart from the welding horn because of an inner loss induced in the member, which makes it difficult to attain a desirable welding energy. A distance which the ultrasonic vibration propagates effectively is regarded in general as from 4 to 5 millimeters (referred to as "mm" hereinafter) in a case when the member is formed of a crystalline plastic resin such as a polypropylene polymer.

However, since the conventional example mentioned above has to have contact the welding horn, which serves for fusing the welding portions 105 and the liquid cartridge 101 to each other, orthogonally with respect to the cylindrical portion of the cap 103 the separates the welding portions 105 remotely more than 5 mm from the welding horn dependently upon shapes of the cartridge and the cap, it hinders an effective propagation of the ultrasonic vibration, resulting in an dissatisfactory welding. To complement the dissatisfactory welding results, it is necessary to provide from 6 to 8 welding portions.

On the other hand, a necessity of providing a stronger ultrasonic vibration induces a fusion between the elastic member 104 and the feeding port 102 which are located adjacently to the welding horn, corresponding to the shapes of the cartridge and the cap. The fusion between the elastic member and the feeding port has a danger that it produces inadequacies such as an increase in operational force during opening and closing the cap 101, a deformation of the feeding port 102 etc. Furthermore, to provide the stronger vibration as mentioned above shortens a service lifetime of the welding horn, which invites an increase in manufacturing cost of the liquid cartridge.

SUMMARY OF THE INVENTION

The present invention is carried out to solve the problem mentioned above. An object of the present invention is to provide a cap for use in liquid cartridge for reserving a liquid and a liquid cartridge having the same which can perform stably a welding between the cap and the liquid cartridge, reduce an unsealing force without sacrificing a welding strength of the cap with the cartridge and thereby enables to improve an operativity during unsealing.

To solve the problems mentioned above, the present invention is constituted as follows:

(1) A cap for use in liquid cartridge, which is constituted of a liquid reserving portion for reserving a liquid and a feeding port for feeding the liquid externally, comprising:

a facing for covering the feeding port;

welding portions to be welded with the liquid cartridge; and an handling portion for releasing the welding portions by means of rotating the cap, wherein:

one of the welding portions is located on an opposing position of another welding portion to each other with respect to a rotational center of the rotating operation; and the welding portions exist approximately on a line which runs through both the rotational center and a substantial center line of the handling portion.

The cap for use in liquid cartridge according to the present invention satisfies the purpose mentioned above by constructing the constitution as mentioned above. However, it might be acceptable to supplement further constitutions mentioned below: Either a singular use only or a complex use of those additional constitutions with each other being combined with the present invention can provide further effects to be described later in the specification.

(2) The present invention mentioned above might further comprise:

a plurality of concavities provided on a front surface of the facing, wherein:

the welding portions might be located on a rear surface of the facing which corresponds to a rear side of bottom surfaces of the concavities.

(3) The welding portions mentioned above might differ in size from each other; and a base portion for supporting the welding portion might be larger in size than the welding portion.

(4) On the other hand, the welding portion mentioned above might have a recess around the base portion for supporting the welding portion to provide a space.

(5) Further, the recess mentioned above might have a cross-sectional area larger than a cross-sectional contact area of the welding horn for welding the welding portions and the liquid cartridge.

(6) Moreover, to satisfy the purpose mentioned above, a liquid reserving cartridge according to the present invention, comprising:

a liquid reserving portion for reserving a liquid;

a feeding port for feeding the liquid externally; and a cap having a facing for covering the feeding port, wherein:

the cap to be welded onto the feeding port comprises a plurality of welding portions, which are to be welded with the liquid reserving cartridge, and a handling portion for rotating the cap thereby to release the welded portions; and the welded portions are located on approximately symmetrical positions of other welded portions to each other with respect to a rotational center of the rotational operation and also located on a substantial center line which runs through the rotational center and through the handling portion.

DETAILED DESCRIPTION OF THE PREFERRED EMBODIMENTS

Figure 1D:
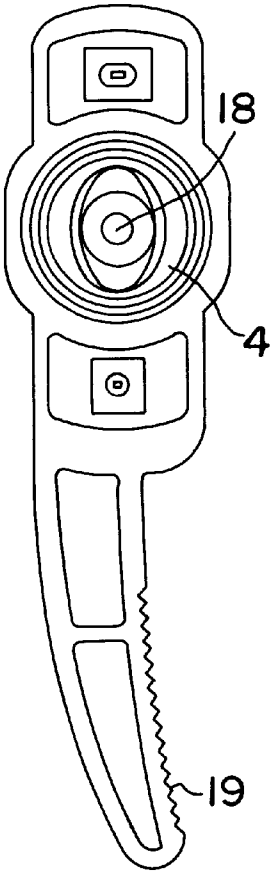
FIG. 1D is a rear view of FIG. 1A.
Figure 1C:
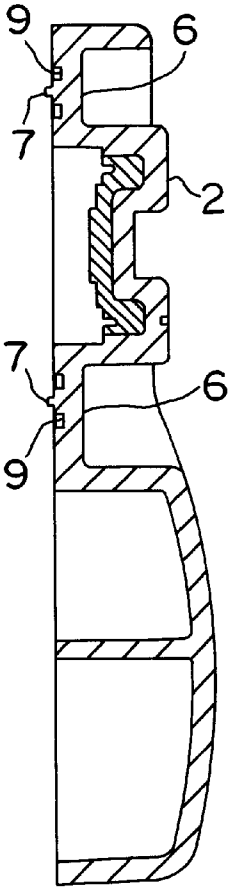
FIG. 1C is a cross-sectional side view of FIG. 1A.
Figure 1B:
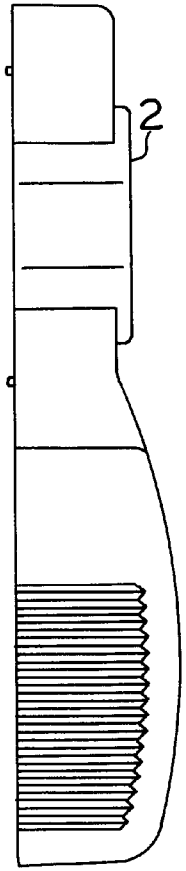
FIG. 1B is a side view of FIG. 1A.
Figure 1A:
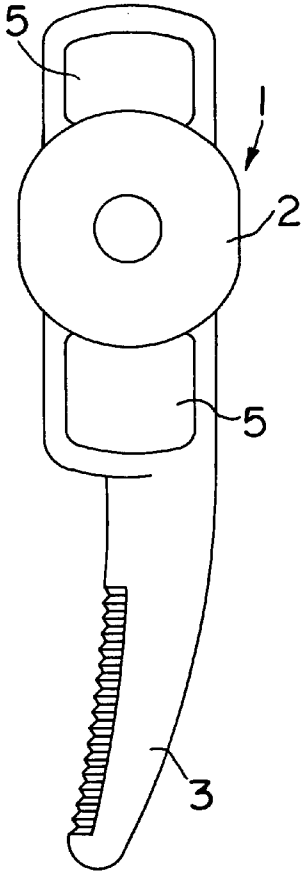
FIG. 1A is a front view showing an embodiment according to the present invention.
Figure 2A:
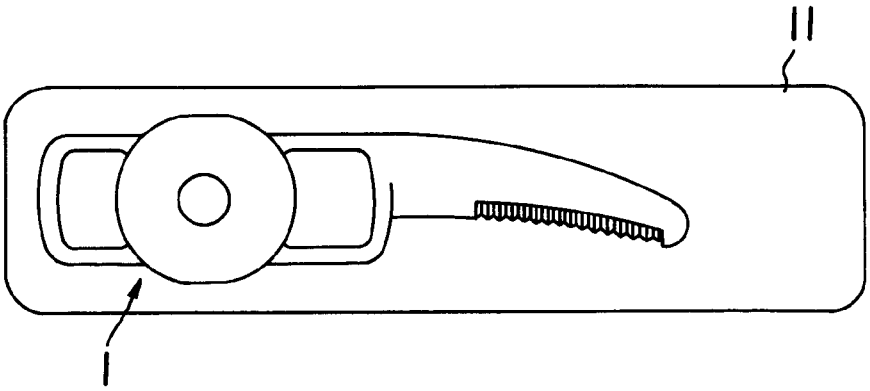
FIG. 2A is a front view showing a constitutional embodiment according to the present invention when a cap for use in liquid reserving cartridge and a liquid reserving cartridge are connected to each other.
Figure 2B:
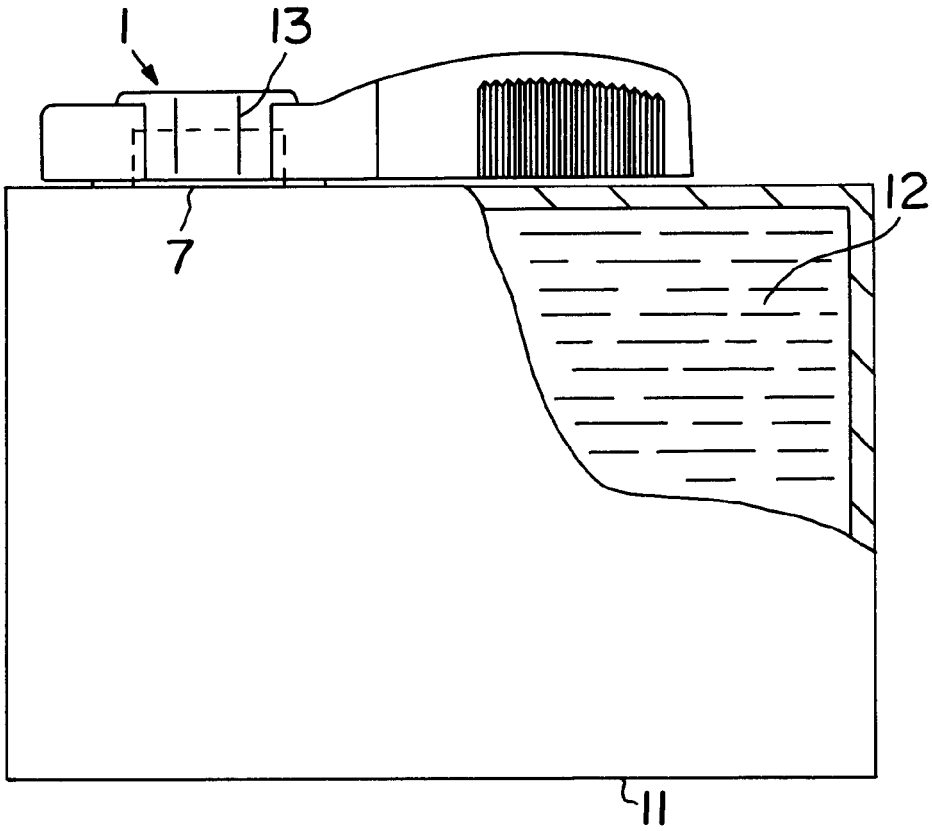
FIG. 2B is a partly cross-sectional side view of FIG. 2A.

Hereinafter detailed are the preferred embodiments according to the present invention with reference to the drawings from FIGS. 1A to 7. The best modes contemplated by the inventors during carrying out the invention into practice will also be described corresponding to the preferred embodiments.

Incidentally, despite that a welding method utilizing an ultrasonic vibration is employed in the present invention, other fixing means such as a thermal fusion, a caulking, a fitting etc. might be applied instead.

In the drawings, 1 stands for a cap, 11 stands for a liquid reserving cartridge, 12 stands for a liquid which is employed for recording in an ink-jet recording apparatus to be reserved in the liquid reserving cartridge and 13 stands for a feeding port for feeding the liquid 12 to a recording device mounted on the inkjet recording apparatus. A numeric sign 2 stands for a facing for covering the feeding port 13 and 3 stands for a handle lever for serving as a force applied point 19 when a user rotates the cap 1. Another numeric sign 18 stands for a fulcrum acting as a center of the rotation and 4 stands for an elastic member for forming a pressurized threading with the feeding port 13 through each threaded coupling means included by the feeding port 13 and the cap 1. Herein 5 and 5 stand for concavities displaced on both sides of the facing 2 and provided with each welding horn contact portion 6 on each inner bottom surface whereon a welding horn is to contact. On the other hand, 7 and 7 stand for welding portions which are provided on a surface opposite to the welding horn contact portions 6 and act as fixing portions between the cap 1 and the liquid reserving cartridge 11. The welding portions 7 are provided at an 1 to 1 rate to the welding horn contact portions 6. They are located on opposing positions to each other with respect to the fulcrum 18 which acts as a rotational center of the cap 1. The opposingly located positions to each other of the welded portions 7 exist on a center line which connects the fulcrum 18 and the handle lever 3. As can be seen from FIGS. 5A and 5B, a welded portion 7*a* located on a handle lever side is constituted to be smaller in size than another welded portion 7*b* located on another side which is opposite to the handle lever side.

Figure 3:
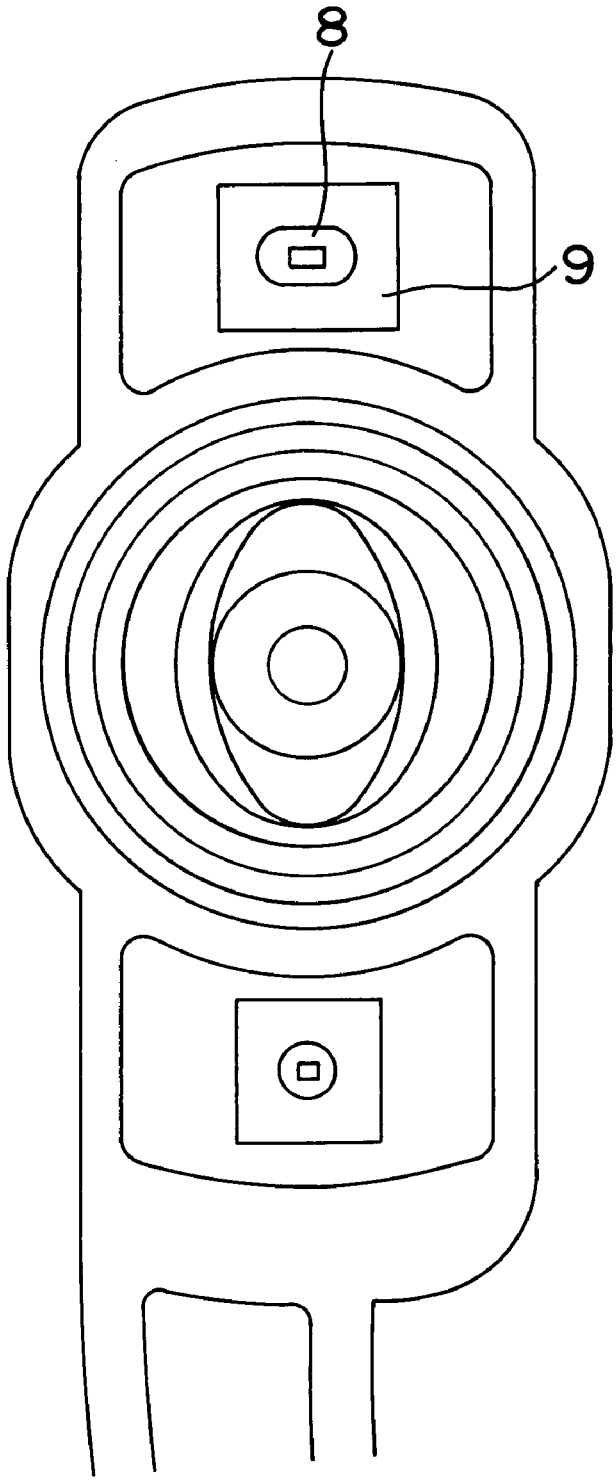
FIG. 3 is an enlarged view of major constituents of welded portions located on a rear surface of the cap.

FIG. 3 is an enlarged view showing the welded portions 7 wherein 8 stands for bases of the welded portions 7 and 9 stands for recesses provided so as to be capable of forming spaces around the bases 8 of the welded portions 7.

In the present embodiment, the welded portions 7, which are located opposingly to each other with respect to the fulcrum 18 and locations of which are aligned along the center line connecting the fulcrum 18 and the handle lever 3, will first be described.

As can be seen from FIG. 1, a number of the welded portions which have been eight in the conventional example is now reduced to two. Reducing the number of the welded portions as mentioned above can suppress an ill effect resultant from a dispersion in welding strength of individual welding portions, which might influence on a force applied to an unsealing operation, to a minimum extent. Furthermore, a number of ugly traces of the welded portions which are left on the liquid cartridge 11 after removal of the cap 1 is also reduced, which can suppress defects in appearance to a minimum extent.

On the other hand, that the welding portions are located so as to be opposed to each other with respect to the fulcrum 18 of the rotation and disposed on the center line connecting the handle lever 3 with the fulcrum 18 can keep a click feeling agreeably to a hand during unsealing the cap.

A deficient total welding strength invited by reducing the welding portions to the two portions can be compensated by improvement in welding efficiency attainable by means of procedures to be described later.

Subsequently, effects of two concavities 5 and 5 according to the present embodiment are described with reference to FIG. 4.

Figure 4:
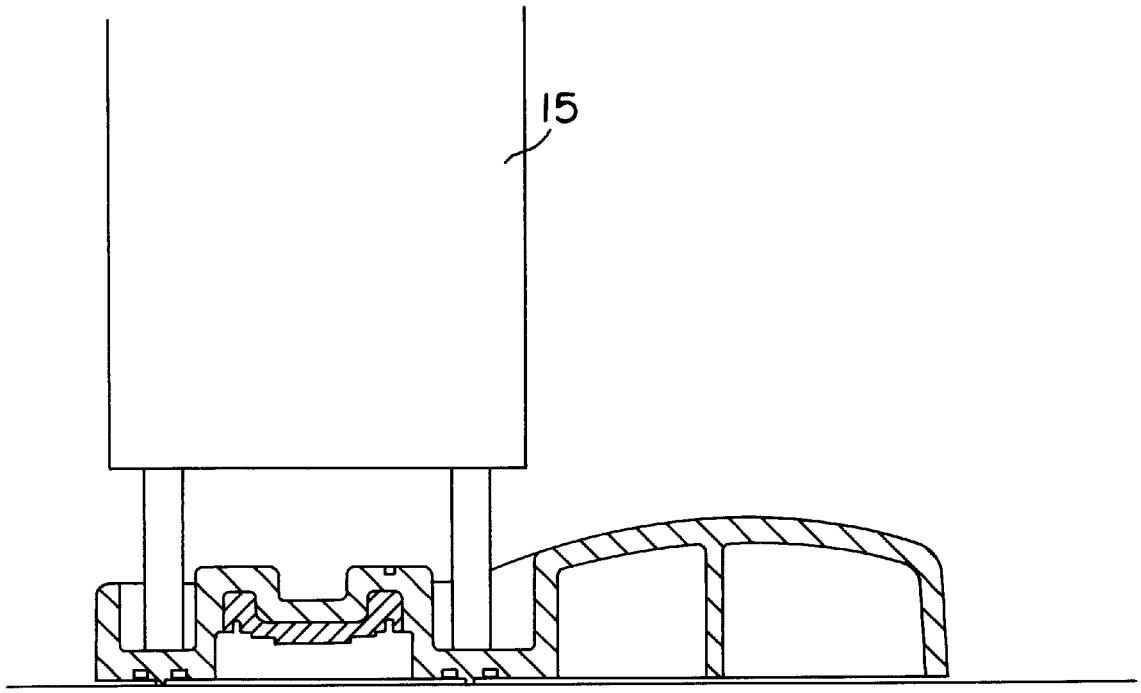
FIG. 4 is a view for illustrating a fusion fixing method.

In FIG. 4, cross-sectional side views of the cap 1 and the welding horn 15 are illustrated. As previously mentioned, fixing the cap 1 onto the liquid cartridge 11 is carried out by fusing and by welding of the welding portions 7, during which the welding horn 15 intrudes into the two concavities 5 provided on the both side of the facing 2 of the cap 1 and contacts on the horn contact portions 6. The welding horn 15 employed for those sorts of purposes has preferably a shape of which tip is branched into fork ends. Then, an ultrasonic vibration is oscillated to fuse the cap 1 and the liquid reserving cartridge 11 to each other, thereby to be fixed. During then, a distance from the horn contact portion 6 to a front end of the welding portion 7 which acts as a tip of the welding portion 7 is kept within 2.5 mm. Since this distance is within a distance wherein the ultrasonic vibration energy can enough propagate effectively, the fusion energy is transferred satisfactorily, thereby to carry out more assuredly the welding which has been insufficient up-to-now. This fact can guarantee the structural strength even at only the two welding portions mentioned above. Further, the constitution according to the present invention saves an ultrasonic energy required for a welding to about a third of that required for the welding of the conventional constitution.

Furthermore, an improvement in propagation efficiency of the ultrasonic vibration lengthens a service lifetime of the welding horn, which can lower a manufacturing cost.

On the other hand, a shortening in propagation length of the ultrasonic vibration enables to employ another ultrasonic vibration having a higher vibrational frequency that has been incapable of being used hitherto because of a too short propagation distance, which can complete the welding in a shorter elapsed time, thereby reducing an occupation time of equipment.

Moreover, another fact that the welding horn contact portion 6 is disposed remotely from a pressurized threading plane threaded between the elastic member 4 and the feeding port 13 can avoid the fusion between them which is induced by the ultrasonic vibration, thereby attaining a stabilization in unsealing force of the cap and thereby preventing a deformation of the feeding port.

Subsequently, the effect of the welding portions 7 is described with reference to FIGS. 5A and 5B.

Figure 5B:
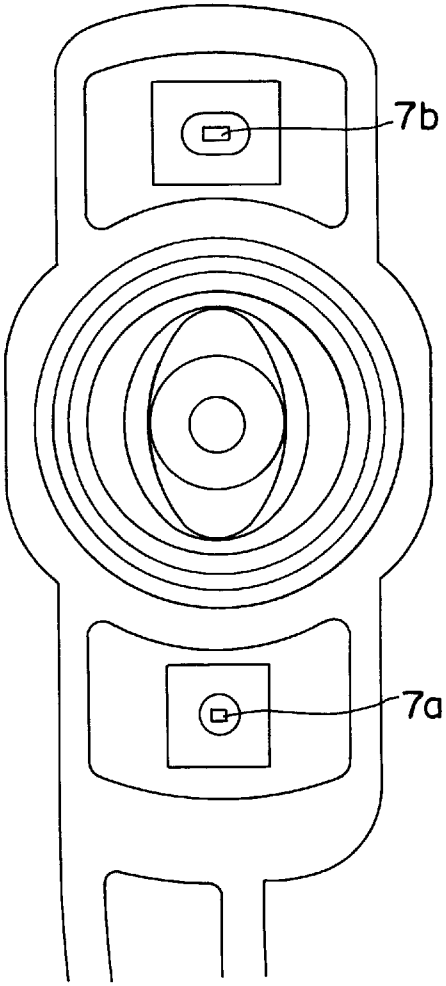
FIG. 5B is an enlarged view of major constituents of welded portions located on the rear surface of the cap when recesses exist.
Figure 5A:
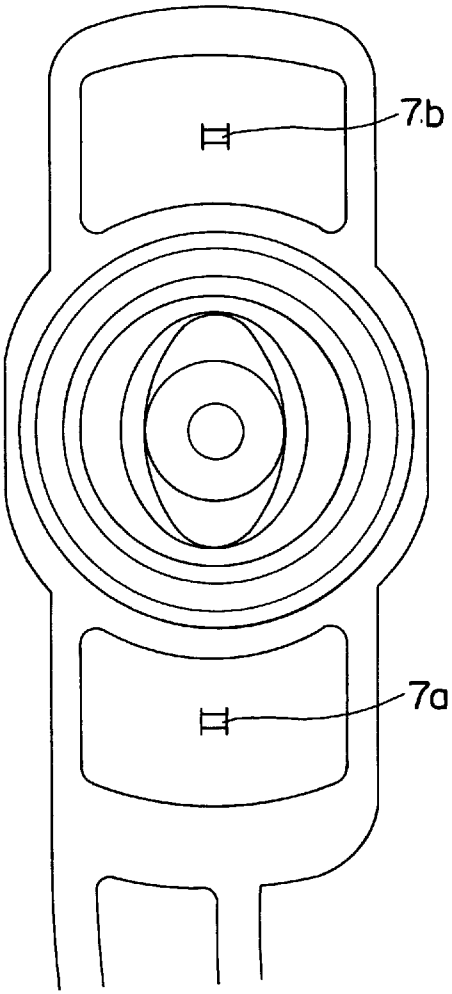
FIG. 5A is an enlarged view of major constituents of welded portions located on the rear surface of the cap when no recess exists.

FIG. 5A is a view showing the welding portion 7 having no recess which is initially investigated in the present embodiments while FIG. 5B is a view showing the welding portion 7 having the recesses 9 which is the finalized status of the present embodiments.

In FIG. 5A, the welding portion 7*a* and welding portion 7*b* is equalized in size. On that occasion, if the welding strength is specified so that the cap 1 will not fall down from the liquid reserving cartridge 11 during, for instance, a dropping test, the operational force during unsealing stays enough within a specification.

Further, in order to increase a production margin of the welding strength, differentiating dimensions of the welding portions 7*a* and 7*b*, namely making the welding portion 7*a* smaller in size than the welding portion 7*b*, can enlarge the production margin which satisfies both the dropping test and the unsealing operational force.

Hereinafter is described a principle whereby the above-mentioned result is obtained.

Figure 7:
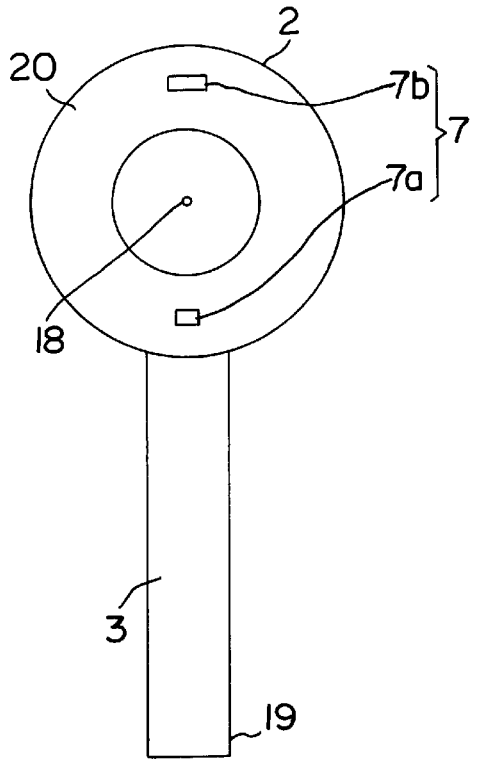
FIG. 7 is a schematic view for illustrating the rear surface of the cap.

As can be seen from FIG. 7, since the welding portions 7*a* and 7*b* are respectively located on the same distance from the fulcrum 18, summarized forces which are a double of an individual single breakdown strength of the two welding portions is necessary to unseal the cap 1 when a force is applied to a force applying point 19 during unsealing because both welding portions have the same welding strength if the welding portions 7*a* and 7*b* are equal in size and in distance as shown in FIG. 5A. On the contrary, if the welding portions 7*a* is made smaller in size than the welding portions 7*b* as shown in FIG. 5B, the unsealing processing passes first a step of breaking down the welding portion 7*a* of which welding strength is comparatively weak and, after that, another step of breaking down the welding portion 7*b*. The force required for unsealing the cap during that takes a maximum value when the welding portion 7*b* is to be broken down, which turns out to be theoretically a half of the case shown in FIG. 5A. The durability strength during the dropping test is guaranteed mainly by the welding strength of the portion 7*b*.

Instead of the change in size of 7*a* from 7*b*, a distance from 7*a* to the fulcrum 18 can be reduced than that from 7*b* to the fulcrum 18.

Figure 6A:
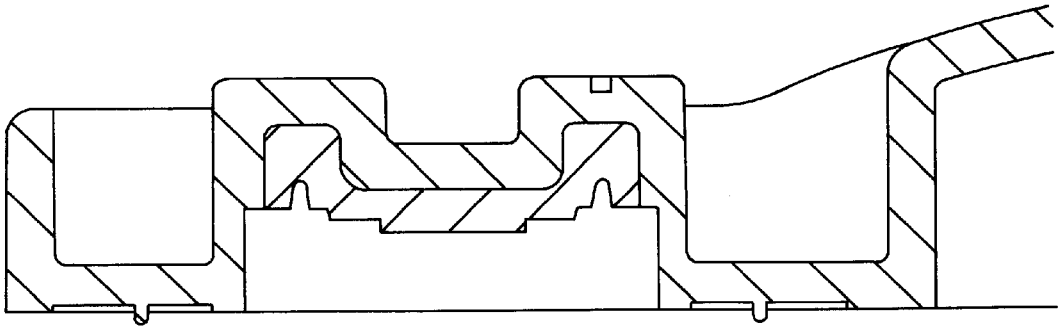
FIG. 6A is an enlarged side view of major constituents of welded portions when no recess exists.

Next, an effect of the bases of the welding portions 7 is described with reference to FIGS. 6A and 6B. FIG. 6A is a view showing the base of the welding portion having no recess which is investigated mainly during an initial inventive stage of the present embodiment while FIG. 6B is a view showing a finalized constitution as the base of the welding portion.

As can be seen from FIG. 6A, the base 8 of the welding portion 7 is formed so as to have the same size in diameter as that of the welding portion 7 and there exists no recess 9. On that occasion, some portions of the plane 20 illustrated in FIG. 7 whereon the welding portions 7 are to be formed by a pressurizing force generated from the welding horn 15 exhibit unwilling welding excessively onto the liquid reserving cartridge 11 even though it does not grow actually to be the dispersion in welding strength.

Figure 6B:
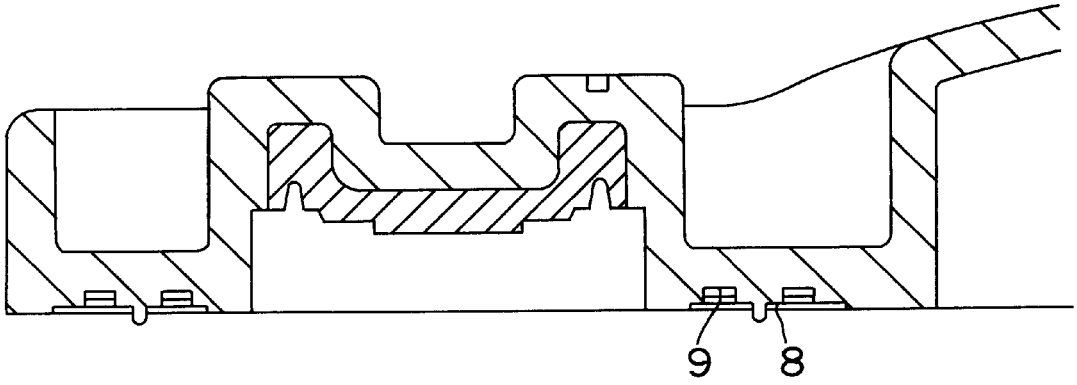
FIG. 6B is an enlarged side view of major constituents of welded portions when recesses exist.

When the recesses 9 having larger areas than those whereon the welding horn 15 has to contact are provided around the welding portions 7 formed on the plane 20 of FIG. 7, the phenomena observed in FIG. 6A are completely solved as can be seen from FIG. 6B.

However, a merely providing the recess 9 lengthens simply the welding portion 7, which causes another inadequacies such as a bulking induced by yielding to the pressurized force generated from the welding horn 15 etc. Accordingly, to enlarge the base 8 of the welding portion 7 larger in diameter than the welding portion 7 itself as shown in FIG. 6B solves similarly the second inadequacies.

As have been described so far, the constitution according to the present invention reduces the number of the ugly welding portions so that it can not only stabilize both the welding strength and the unsealing operational force but also reduce the welding traces residual on the liquid reserving cartridge, which enables to suppress the defects in outlook appearance of the liquid cartridges. The reduction in number of the welding portions also reduces the distance from the contact portion of the welding horn to the welding portion, thereby to enable raising the propagation effecincy of the ultrasonic vibration during welding the cap with the liquid reserving cartridge, which can reduce the energy required for welding less than a third of that of so far and lengthen the service lifetime of the welding horn, resulting in manufacturing cost reduction. Furthermore, it brings about the other effects such as enabling to shorten the welding time because it can employ the ultrasonic vibrations having the higher frequencies than those used so far.

Moreover, as the contact portion with the welding horn according to the present invention is disposed remotely from the pressurized contacting portion of the elastic member of the feeding port, the welding between the elastic member and the feeding port unexpectedly induced by the ultrasonic vibration can be avoided, which serves to stabilize the unsealing operational force and to prevent the feeding port from deformation.

The change in size of the welding portion can afford a welding strength which satisfies both the drop test durability and the ease of the unsealing operation. Either enlarging the base of the welding portion in size or providing the recess can stabilize further the welding strength.

What is claimed is:

1. A cap for use in liquid cartridge which is constituted of a liquid reserving portion for reserving a liquid and a feeding port for feeding said liquid externally, comprising:

a facing for covering said feeding port;

welding portions to be welded with said liquid cartridge; and a handling portion for releasing said welding portion by means of rotating said cap, wherein:

one of said welding portions is located in an opposing position of another of said welding portions to each other with respect to a rotational center of said rotating of said cap; and said welding portions exist approximately on a line which runs through both said rotational center and a substantial center line of said handling portion.

2. The cap in use for liquid cartridge according to claim 1, further comprising:

a plurality of concavities provided on a front surface of said facing, wherein:

the welding portions are located on a rear surface of said facing which corresponds to a rear side of bottom surfaces of said concavities.

3. The cap in use for liquid cartridge according to claim 1, wherein:

said welding portions differ in size from each other.

4. The cap in use for liquid cartridge according to claim 1, wherein:

a base portion for supporting each of said welding portions is larger in size than each of said welding portions.

5. The cap in use for liquid cartridge according to claim 1, wherein:

each of said welding portions has a recess around a welding portion base for supporting each of said welding portions to provide a space.

6. The cap in use for liquid cartridge according to claim 5, wherein:

said recess has a cross-sectional area larger than a cross-sectional contact area of a welding horn for welding one of said welding portions and said liquid cartridge.

7. A liquid reserving cartridge which is equipped with both a liquid reserving portion for reserving a liquid and a feeding port for feeding said liquid externally, wherein:

a cap having a facing for covering said feeding port is welded onto said feeding port;

said cap comprising welding portions to be welded with said liquid cartridge and a handling portion for rotating said cap to release said welding portions;

said welding portions opposing each other with respect to a rotational center of said rotating of said cap; and are located approximately on a center line which goes through both said rotational center and a substantial center line of said handling portion.

* * * * *

UNITED STATES PATENT AND TRADEMARK OFFICE

CERTIFICATE OF CORRECTION

PATENT NO. : 6,216,906 B1
DATED : April 17, 2001
INVENTOR(S) : Hiroshi Koshikawa et al.

It is certified that error appears in the above-identified patent and that said Letters Patent is hereby corrected as shown below:

Title page,
Item [57], ABSTRACT, line 1, "in use for" should read -- for use in --.

Figure 8:
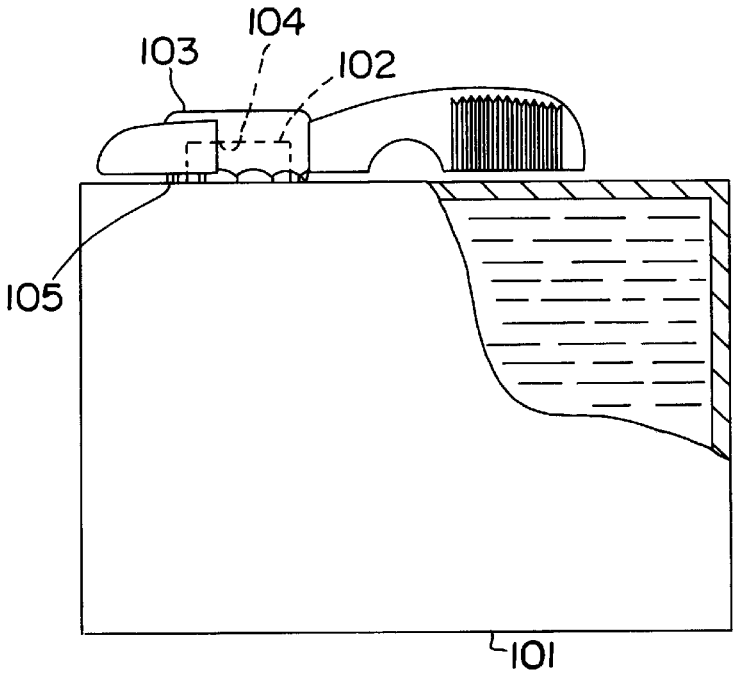
FIG. 8 (PRIOR ART) is a partly cross-sectional side view showing a conventionally constituted example.

Drawings,
Sheet 7, label Figure 8: -- PRIOR ART --.

Column 1,
Line 67, "have" should be deleted.

Column 2,
Line 3, "the separates" should read -- that separates --;
Line 7, "dissatisfactory" should read -- unsatisfactory -- and "dissatisfac-" should read -- unsatisfac- --;
Line 41, "an" should read -- a --.

Column 4,
Line 27, "an" should read -- a -- ;
Line 62, "click feeling agreeably" should read -- sensation agreeable --.

Column 5,
Line 9, "side" should read -- sides --;
Line 15, "then" should read -- that fusing --;
Line 21, "up-to-now." should read -- up to now. --;
Line 52, "is" should read -- are --.

Column 6,
Line 7, "portions 7a" should read -- portion 7a --;
Line 8, "portions 7b" should read -- portion 7b --;
Line 19, "than that" should read -- to less than that --;
Line 34, "unwilling" should read -- unintended --;
Line 44, "equacies" should read -- equacy --;
Line 48, "inadequacies." should read -- inadequacy. --.

Column 7,
Line 31, "in use for" should read -- for use in --.

UNITED STATES PATENT AND TRADEMARK OFFICE

CERTIFICATE OF CORRECTION

PATENT NO. : 6,216,906 B1
DATED : April 17, 2001
INVENTOR(S) : Hiroshi Koshikawa et al.

It is certified that error appears in the above-identified patent and that said Letters Patent is hereby corrected as shown below:

Column 8,
Line 4, "in use for" should read -- for use in --;
Line 6, "in use for" should read -- for use in --;
Line 10, "in use for" should read -- for use in --;
Line 15, "in use for" should read -- for use in --.

Signed and Sealed this

Ninth Day of April, 2002

*Attest:*

*Attesting Officer*

JAMES E. ROGAN
*Director of the United States Patent and Trademark Office*